US006839529B2

(12) United States Patent
Yasui et al.

(10) Patent No.: US 6,839,529 B2
(45) Date of Patent: Jan. 4, 2005

(54) DEVELOPING DEVICE AND PROCESS CARTRIDGE

(75) Inventors: Kojiro Yasui, Shizuoka (JP); Susumu Nittani, Shizuoka (JP); Hideki Maeshima, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/355,076

(22) Filed: Jan. 31, 2003

(65) Prior Publication Data

US 2003/0152396 A1 Aug. 14, 2003

(30) Foreign Application Priority Data

Feb. 1, 2002 (JP) ..... 2002-026126

(51) Int. Cl.[7] ..... G03G 15/08
(52) U.S. Cl. ..... 399/103; 399/106
(58) Field of Search ..... 399/98, 102, 103, 399/105, 106, 119

(56) References Cited

U.S. PATENT DOCUMENTS 5,585,895 A * 12/1996 Yashiro et al. ..... 399/103
5,790,923 A 8/1998 Oguma et al. ..... 399/106
6,070,027 A * 5/2000 Kawai et al. ..... 399/103
6,282,395 B1 8/2001 Nittani et al. ..... 399/284
6,336,014 B1 * 1/2002 Sato et al. ..... 399/103
6,411,791 B2 6/2002 Nittani et al. ..... 399/281
6,438,347 B2 8/2002 Nittani et al. ..... 399/284
2001/0031158 A1 10/2001 Yokomori et al. ..... 399/284
2002/0048474 A1 4/2002 Arimitsu et al. ..... 399/350

FOREIGN PATENT DOCUMENTS

JP 2000-284589 10/2000

* cited by examiner

*Primary Examiner*—Hoan Tran
(74) *Attorney, Agent, or Firm*—Fitzpatrick, Cella, Harper & Scinto

(57) ABSTRACT

In order to provide a developing device and a process cartridge that are capable of preventing leakage of developer at low cost, for example, a developing device includes a container for containing a developer; a developer collecting member, a flexible sheet, a developer separating member, and a developer collecting member mounted at least a part of which is provided on an upper surface of the flexible sheet and which is provided so as to be free of contact with the developing roller, for preventing spurt of developer from a gap between the photosensitive drum and the developing device container. A process cartridge for an image forming apparatus includes a photosensitive drum and the previously-described developing device.

17 Claims, 5 Drawing Sheets

DEVELOPING DEVICE AND PROCESS CARTRIDGE

BACKGROUND OF THE INVENTION

1. Field of the Invention

The present invention relates to a developing device in an image forming apparatus such as a copying machine or a printer and the like employing recording system such as an electrophotographic recording system or an electrostatic recording system and the like, and to a process cartridge on which such developing device is mounted.

2. Description of the Related Art

In an image forming apparatus in which images are formed on a recording sheet using developer such as toner and the like, various measures are taken for preventing leakage of developer in order to improve quality of the apparatus.

Especially, in developing units containing developer, or in an apparatus in which a unit of a photosensitive member and a developing unit is replaceable, vibrations are generated not only during operation of the image forming apparatus, but also during replacing operation. As a consequence, developer is liable to leak, and thus more reliable countermeasure against leakage is required. In particular, developer is liable to leak from the portion of the developing device container where a developing roller is disposed since there is formed an opening for supplying developer to the photosensitive member. Therefore, various measures for preventing leakage of developer through such opening have been proposed.

For example, a cartridge as proposed in JP-A-2000-284589 includes an end portion sealing member disposed at the longitudinal ends of a developing roller along the periphery of the developing roller in order to prevent leakage of developer from the longitudinal ends of the developing roller and a flexible sheet member (spurt preventing sheet) for preventing spurt of toner from a gap formed between the developing roller and the developer container along the length of the developing roller.

The end portion sealing member is a member having a multiple layer structure including a surface layer formed, for example, of non-woven fabric such as PTFE, nylon, rayon and the like, or of felt or pile fabric and the like, and a cushioned base layer member such as sponge and the like bonded together with double-face adhesive tape or the like.

The flexible sheet member is formed, for example, of resin sheet such as PET and the like, which is fixed at the opening of a developing frame body at one end and is free at the other end and comes into contact with the peripheral surface of the developing roller longitudinally along almost the whole area thereof.

A longitudinal length of the flexible sheet member is such that it extends to the position that can overlap with the end portion sealing member, which allows toner that was not developed and returned into the container to pass under the opening, and prevents toner from spurting out therefrom.

However, it has been desired to further improve sealing capability because of the influence of reduction of the diameter of toner for improving picture quality, a high-speed sliding movement of the developing roller and the end portion sealing member as a result of speeding-up of image output, and elongation of life of the developing device.

SUMMARY OF THE INVENTION

Accordingly, it is an object of the invention to provide a developing device in which leakage of developer may be prevented and a process cartridge therefore.

It is another object of the invention to provide a developing device which is cost effective and is superior in sealing capability for developer and a process cartridge therefor.

It is still another object of the invention to provide a developing device including: a container, having an opening, for containing a developer; a developer carrying member, rotatably disposed in the opening, for carrying the developer; and a developer collecting member mounted at the opening of the container so as to be kept out of contact with the developer carrying member.

It is further object of the invention to provide a process cartridge including an image bearing member; a container, having an opening, for containing a developer; a developer carrying member, rotatably disposed in the opening, for carrying the developer; and a developer collecting member mounted at the opening of the container so as to be kept out of contact with the developer carrying member and the image bearing member.

Further objects of the invention will be apparent from detailed description shown below while referring to attached drawings.

DESCRIPTION OF THE PREFERRED EMBODIMENTS

Figure 1:
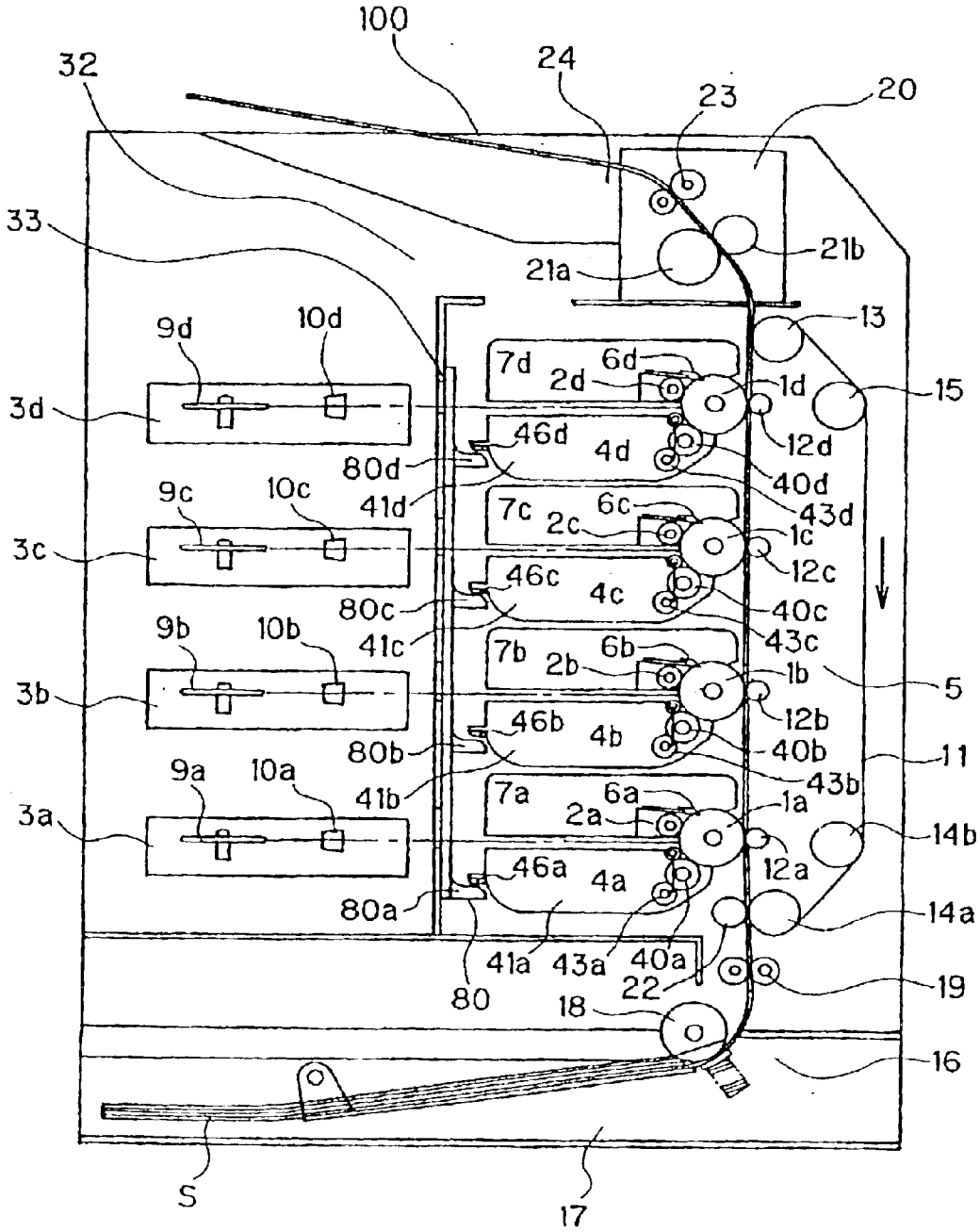
FIG. 1 is a vertical cross sectional view showing an entire structure of a full color laser beam printer 100 as an example of the image forming apparatus on which a process cartridge 7 of the invention is mounted.

Referring now to the drawings, preferred embodiment of the invention will be described in detail. However, dimensions, qualities of material, configurations, and relative positions of the components set forth in these embodiments are not intended to limit the scope of the invention unless otherwise specifically described.

The same reference numerals represent the same members having the same function throughout the drawings.

Referring to the drawings, a first embodiment of the image forming apparatus will now be described in detail.

[Entire Structure of Full Color Laser Beam Printer]

FIG. 1 is a vertical cross sectional view showing an entire structure of a full color laser beam printer 100 as an example of the image forming apparatus on which a process cartridge of the invention is mounted.

The full color laser beam printer 100 shown in the same figure is provided with four photosensitive drums 1*a*, 1*b*, 1*c* and 1*d* (hereinafter also referred to simply as a photosensitive drum 1) disposed in parallel in the vertical direction.

The photosensitive drum 1 is rotated counterclockwise in the figure by a drive unit (not shown).

Around the photosensitive drum 1, there are provided charging devices 2*a*, 2*b*, 2*c* and 2*d* (hereinafter referred also to simply as a charging device 2) for uniformly charging the surface of the photosensitive drum 1, and scanner units 3*a*, 3*b*, 3*c* and 3*d* (hereinafter referred also to simply as a scanner unit 3) for irradiating laser beam based on the image data and forming an electrostatic latent image on the photosensitive drum 1 disposed in the order in the rotating direction thereof.

Furthermore, around the photosensitive drum 1, there are provided developing devices 4*a*, 4*b*, 4*c* and 4*d* (hereinafter referred also to simply as a developing device 4) for allowing toner to attach on the electrostatic latent image to develop the same as a toner image, and an electrostatic image transfer device 5 for allowing the toner image on the photosensitive drum 1 to be transferred on a transfer material S, and cleaning devices 6*a*, 6*b*, 6*c* and 6*d* (hereinafter referred also to simply as a cleaning device 6) for removing residual toner remaining on the surface of the photosensitive drum 1 after transfer operation.

The photosensitive drum 1, the charging device 2, the developing device 4, and the cleaning device 6 are integrally stored into a cartridge so as to form process cartridges 7*a*, 7*b*, 7*c* and 7*d* (hereinafter referred also to simply as a process cartridge 7).

These four process cartridges 7 are detachably mountable on the main assembly of the full color laser beam printer 100 respectively.

A detailed description will now be made in the order from the photosensitive drum 1. The photosensitive drum 1 is formed, for example, by applying an organic photoconductor layer (OPC photosensitive member) on the outer periphery of an aluminum cylinder of 30 mm in diameter.

The photosensitive drum 1 is rotatably supported by a supporting member at both ends thereof, and is rotated counterclockwise in FIG. 1 by a driving force being transmitted from a drive motor (not shown) to one of the ends thereof.

The charging device 2 may be the one employing a contact charging system. The charging member is a conductive roller formed into a roller shape, for allowing the surface of the photosensitive drum 1 to be charged uniformly by bringing the roller into contact with the surface of the photosensitive drum 1 and applying a charging bias voltage onto the roller.

The scanner unit 3 is disposed in substantially the same horizontal level with respect to the photosensitive drum 1. A laser diode (not shown) emits light in response to image signals, and the emitted image light is irradiated on polygon mirrors 9*a*, 9*b*, 9*c* and 9*d* (hereinafter referred also to simply as a polygon mirror 9) rotated at a high speed by a scanner motor (not shown).

The image light reflected from the polygon mirror 9 exposes the charged surface of the photosensitive drum 1 via image forming lenses 10*a*, 10*b*, 10*c* and 10*d* (hereinafter referred also to simply as an image forming lens 10). Accordingly an electrostatic latent image in accordance with image data is formed.

The developing device 4 includes toner containers 41*a*, 41*b*, 41*c* and 41*d* containing yellow toner, magenta toner, cyan toner and black toner respectively (hereinafter referred also to simply as a toner container 41), and a developing device container 45 (FIG. 2) having developing roller and the like therein. Toner in the toner container 41 is fed to toner supply rollers 43*a*, 43*b*, 43*c* and 43*d* (hereinafter referred also to simply as a toner supply roller 43) by a toner transporting mechanism (not shown).

Toner is supplied from the toner supply roller 43 rotating clockwise (Z direction) in FIG. 2 onto the peripheral surfaces of developing rollers 40*a*, 40*b*, 40*c* and 40*d* (hereinafter referred also to simply as a developing roller 40) rotating also clockwise (Y direction). A developing blade 44 (See FIG. 2), which is in press contact with the outer periphery of the developing roller, regulates the thickness of the toner layer on the developing roller 40 and provides electric charge to toner.

Then by applying developing bias to the developing roller 40 facing toward the photosensitive drum 1 on which the latent image is formed, the electrostatic latent image on the photosensitive drum 1 is developed by toner.

An electrostatic transfer belt 11 that circulates when moved is disposed so as to oppose all the photosensitive drums 1*a*, 1*b*, 1*c* and 1*d* in contact thereto.

The electrostatic transfer belt 11 is constructed of a film member of about 150 $\mu$m in thickness having volume specific resistance ranged between $10^{11}$–$10^{14}$ $\Omega\cdot$cm.

The electrostatic transfer belt 11 being tensed by four rollers (13, 14*a*, 14*b* and 15). The electrostatic transfer belt 11 electrostatically adsorbs a transfer material S on the outer peripheral surface on the left side of the figure and circulates so as to bring the transfer material S into contact with the above-described photosensitive drum 1.

Accordingly, the transfer material S is transported to the transfer position by the electrostatic transfer belt 11 and then the toner image on the photosensitive drum 1 is transferred thereto.

Transfer rollers 12*a*, 12*b*, 12*c* and 12*d* (hereinafter referred also to simply as a transfer roller 12) are disposed in parallel at the positions facing toward the four photosensitive drums 1*a*, 1*b*, 1*c*, and 1*d* so as to be in contact with the inner side of the electrostatic transfer belt 11.

Electric charge of positive polarity is applied from these transfer rollers 12 to the transfer material S via the electrostatic transfer belt 11, and a toner image of negative polarity on the photosensitive drum 1 is transferred on the transfer material S which is in contact with the photosensitive drum 1 by the electric field formed by such electric charge.

The electrostatic transfer belt 11, having a peripheral length of about 700 mm and a thickness of 150 $\mu$m, is fitted around the four rollers; the belt driving roller 13, the driven rollers 14*a* and 14*b*, and the tension roller 15, and rotates in the direction indicated by an arrow in the figure.

Accordingly, the electrostatic transfer belt 11 circulates and the toner image is transferred on the transfer material S while it is transported from the driven roller 14*a* side to the driving roller 13 side.

A paper feed unit 16 feeds and transports the transfer material S to an image forming unit. A plurality of transfer materials S are accommodated in a paper feed cassette 17.

When forming the image, a paper feed roller 18 (a half-moon roller)and a pair of resist rollers 19 rotate in accordance with the image forming operation, and feed the transfer material S in the paper feed cassette 17 separately per sheet. The transfer material S stops once when the leading edge is brought into contact with the pair of resist rollers 19, forms a loop, and then is fed to the electrostatic transfer belt 11 by the pair of resist rollers 19 while synchronizing the initiation of image formation with the rotation of the electrostatic transfer belt 11.

A fixing unit 20 fixes the toner image consisting of a plurality of colors transferred on the transfer material S, and includes a rotating heating roller 21*a* and a pressurizing roller 21*b* rotating in press-contact therewith for applying heat and pressure on the transfer material S.

In other words, the transfer material S on which the toner image on the photosensitive drum 1 is transferred is transported by the pair of fixing rollers consisting of the heating roller 21*a* and the pressurizing roller 21*b* when passing through the fixing unit 20, and is applied with heat and pressure by the pair of fixing rollers. As a consequence, a toner image of a plurality of colors is fixed on the surface of the transfer material S.

The operation for forming an image is such that the process cartridges 7*a*, 7*b*, 7*c* and 7*d* are driven sequentially according to the printing timing, and the photosensitive drums 1*a*, 1*b*, 1*c* and 1*d* are rotated counterclockwise in response thereto.

Then, the scanner unit 3 corresponding to each process cartridge 7 is sequentially driven.

In such operation, the charging device 2 charges the peripheral surface of the photosensitive drum 1 uniformly, and the scanner unit 3 exposes the peripheral surface of the photosensitive drum 1 in response to image signals to form an electrostatic latent image on the peripheral surface of the photosensitive drum 1.

The developing roller 40 in the developing device 4 transfers toner to the low-potential portion of the electrostatic latent image to form (develop) a toner image on the peripheral surface of the photosensitive drum 1.

The pair of resist rollers 19 starts rotating and feed the transfer material S to the electrostatic transfer belt 11 at the timing when the leading edge of the toner image on the peripheral surface of the upstreammost photosensitive drum 1 rotatingly reaches the point opposed to the electrostatic transfer belt 11 so that the print starting position on the transfer material S coincides with the opposed point.

By clamping the transfer material S between an electrostatic adsorption roller 22 and the electrostatic transfer belt 11 in press contact with the outer peripheral surface of the electrostatic transfer belt 11 and applying voltage between the electrostatic transfer belt 11 and the electrostatic adsorption roller 22, electric charge is induced on the transfer material S, which is a dielectric material, and a dielectric layer of the electrostatic transfer belt 11 to electrostatically adsorb the transfer material S on the outer periphery of the electrostatic transfer belt 11.

Accordingly, the transfer material S is adsorbed stably by the electrostatic transfer belt 11, and transported to the downstreammost transfer unit.

The transfer material S, while being thus transported, is transferred with the toner images on each photosensitive drum 1 sequentially by electric field formed between each photosensitive drum 1 and the transfer roller 12.

The transfer material S transferred with toner images of four colors is separated from the electrostatic transfer belt 11 due to the curvature of the belt driving roller 13, and transported into the fixing unit 20.

The transfer material S is, after the aforementioned toner image is fixed thereon by being heated in the fixing unit 20, discharged by a pair of paper discharging rollers 23 through a paper discharge unit 24 out of the main assembly with the surface on which the image is transferred down.

Figure 2:
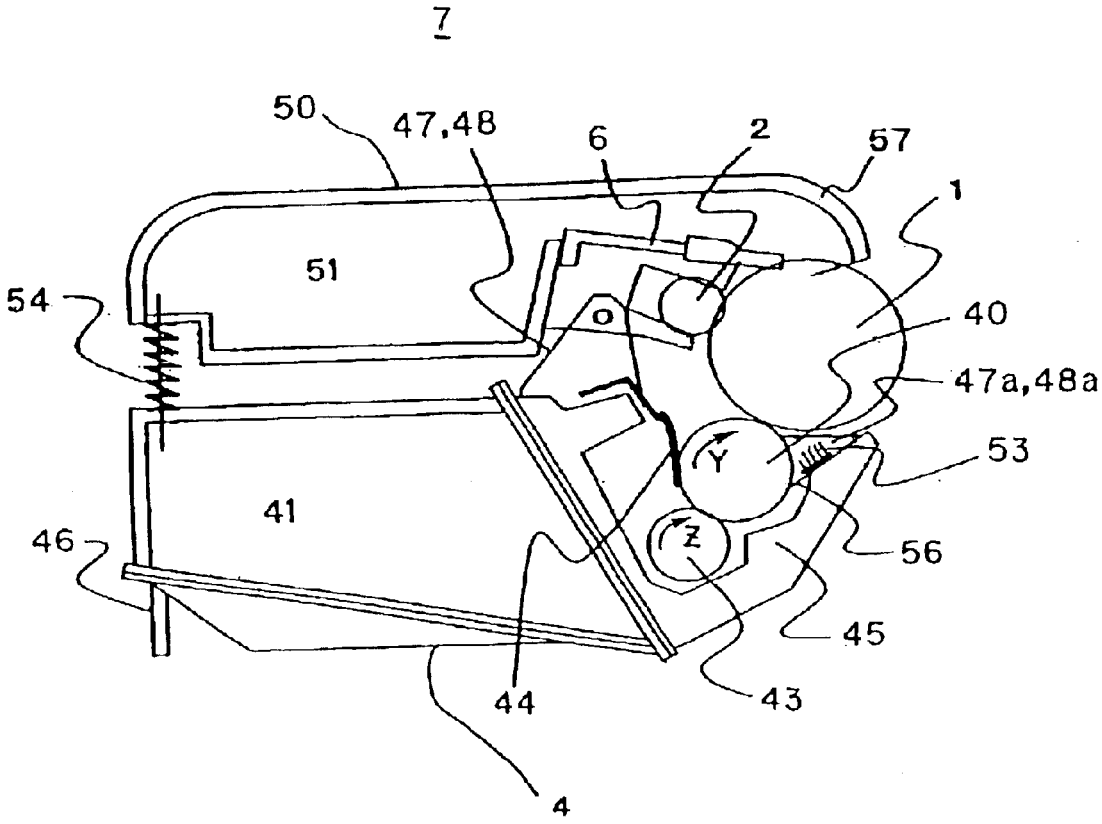
FIG. 2 is a cross sectional view of the process cartridge 7 shown in FIG. 1.
Figure 3:
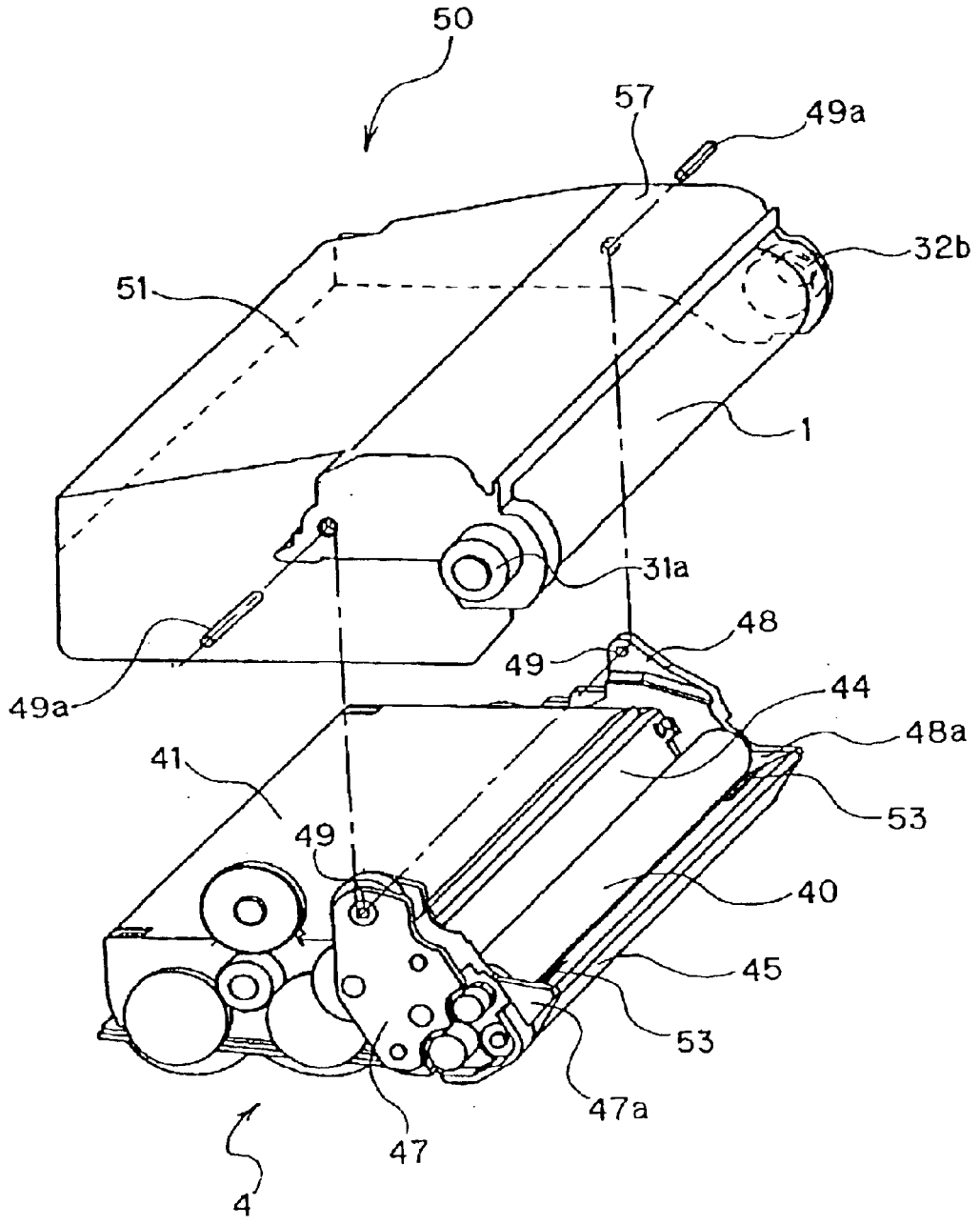
FIG. 3 is a perspective view of the process cartridge 7 shown in FIG. 1.

Referring now to FIG. 2 and FIG. 3, the process cartridge, which is applied to the image forming apparatus shown in FIG. 1, will be described in detail.

FIG. 2 is a cross sectional view of the process cartridge 7 accommodating toner shown in FIG. 1, and FIG. 3 is a perspective view of the process cartridge 7 accommodating toner shown in FIG. 1. The process cartridges shown in FIG. 2 and FIG. 3 correspond to an embodiment of the process cartridge according to the invention.

Since the process cartridges 7*a*, 7*b*, 7*c* and 7*d* for yellow, magenta, cyan and black are the same in construction, the process cartridges 7*a*, 7*b*, 7*c* and 7*d* are collectively referred to as process cartridge 7 in the description below.

The process cartridge 7 includes an electrophotographic photosensitive member in a drum shape that serves as an image bearing member, or the photosensitive drum 1, a photosensitive drum unit 50 including a charging device and a cleaning device, and the developing device 4 having a developing unit for developing an electrostatic latent image on the photosensitive drum 1.

The photosensitive drum unit 50 is provided with the photosensitive drum 1 rotatably attached on a cleaning frame body 57 via bearings 31*a* and 32*b*.

The charging device 2 for charging the surface of the photosensitive drum 1 uniformly and the cleaning device 6 for removing toner remaining on the photosensitive drum are disposed on the periphery of the photosensitive drum 1 on the side of the photosensitive drum unit 50.

The cleaning device 6 is constructed, for example, of a cleaning blade.

The residual toner removed from the surface of the photosensitive drum 1 by the cleaning device 6 is fed by a toner feeding mechanism (not shown) sequentially to a waste toner chamber 51 provided behind the cleaning frame body 57.

The photosensitive drum 1 is rotated counterclockwise in the figure in accordance with the image forming operation by transmitting a driving force of the driving motor, not shown, to the end, on the far side in the figure, of the photosensitive drum 1.

The developing device 4 includes a developing roller 40 rotating in the direction indicated by an arrow Y in contact with the photosensitive drum 1, a toner container 41 containing toner, and a developing device container 45.

The developing roller 40 is rotatably supported by side walls 47, 48 of the developing device container 45 provided with bearings, and a toner feeding roller 43 rotating in the direction indicated by an arrow Z in contact with the developing roller 40 and a developing blade 44 are disposed on the periphery of the developing roller 40.

The toner container 41 includes a toner transporting mechanism (not shown) for stirring toner stored therein and transporting the same to the toner feeding roller 43.

The developing device 4 has a suspended structure in which the entire developing device 4 is supported by the photosensitive drum unit 50 via a pin 49*a* for a swinging motion about supporting shafts 49 provided respectively on the side walls 47 and 48 on longitudinally ends of the developing device 4. In the state of the process cartridge 7 in itself (in which it is not mounted on the main assembly of the image forming device), the developing device 4 is always urged by a pressurizing spring 54 so that the developing roller 40 comes into contact with the photosensitive drum 1 by a moment of rotation about the supporting shafts 49.

In addition, the toner container 41 of the developing device 4 is integrally provided with a rib 46 with which a spacing unit of the full color laser beam printer 100 comes into contact when moving the developing roller 40 away from the photosensitive drum 1. The full color laser beam printer 100 of the present embodiment is constructed in such a manner that the respective developing rollers 40 come into contact with the photosensitive drum 1 during printing job, and move away from the photosensitive drum 1 when the printing job is completed.

When toner is transported to the toner supply roller 43 by a toner transporting mechanism (not shown) when developing, the toner supply roller 43 rotating in the direction indicated by the arrow Z supplies the toner to the developing roller 40 by the sliding friction with the developing roller 40 rotating in the direction indicated by the arrow Y to allow the toner to be carried on the developing roller 40.

Toner carried on the developing roller 40 reaches the developing blade 44 in accordance with the rotation of the developing roller 40, and thus the developing blade 44 provide electric charge to toner, and consequently, a predetermined thin layer of toner is formed on the developing roller 40.

Toner is then transported to the developing portion where the photosensitive drum 1 and the developing roller 40 are in contact with each other, and is adhered on the electrostatic latent image formed on the surface of the photosensitive drum 1 by the direct current developing bias applied from the power source, not shown, to the developing roller 40 at the developing portion to develop the latent image.

Toner remaining on the surface of the developing roller 40, which did not contribute to developing, is returned in the developer container from the developer returning portion at the opening of the developing device container in association with the rotation of the developing roller 40, and is separated and collected from the developing roller 40 at the position in sliding friction with the toner supply roller 43. Collected toner is stirred and mixed with remaining toner by a toner transporting mechanism (not shown).

In a contact developing system in which the photosensitive drum 1 and the developing roller 40 are brought into contact with each other for developing as in the present embodiment, the photosensitive drum 1 preferably has a rigid body, and the developing roller 40 to be used therewith preferably includes a resilient body.

The resilient body to be employed here includes, for example, a resilient body formed by coating resin on the solid rubber layer considering charging capability with respect to a single layer of solid rubber or toner.

A toner sealing structure around the developing roller of the process cartridge according to the present embodiment will be described below.

The process cartridge (developing device) of the present embodiment includes, in order to prevent leakage of the developer from the longitudinal ends of the developing roller 40, an end portion sealing member 52 (See FIG. 4) disposed at the longitudinal ends of the developing roller 40 and circumference of the developing roller 40, and a flexible sheet member (spurt preventing sheet) 56 (See FIG. 2 and FIG. 4) for preventing spurt of toner from the gap (the developer returning portion) between the developing roller 40 and the developing device container 45 formed longitudinally of the developing roller 40.

The end portion sealing member 52 is a member having a multiple layer structure including a surface layer formed, for example, of non-woven fabric such as PTFE, nylon, rayon and the like, or of felt or pile fabric and the like, and a cushioned base layer member such as sponge and the like bonded together with double-face adhesive tape or the like.

The flexible seal member 56 is formed, of resin sheet such as PET and the like, which is fixed at the opening of the developing device container 45 at one end and is free at the other end opposite from the fixed side and comes into contact with the peripheral surface of the developing roller 40 longitudinally along the whole area thereof.

The longitudinal length of the flexible sheet member 56 is such that it extends to the position that can overlap with the end portion sealing member 52, which allows toner that was not developed and returned into the container to pass under the opening, and prevents toner from spurting out therefrom. In addition, according to the present embodiment, a developer collecting member 53 for blocking toner that was failed to be blocked by the spurting preventing sheet 56 is provided.

Figure 4:
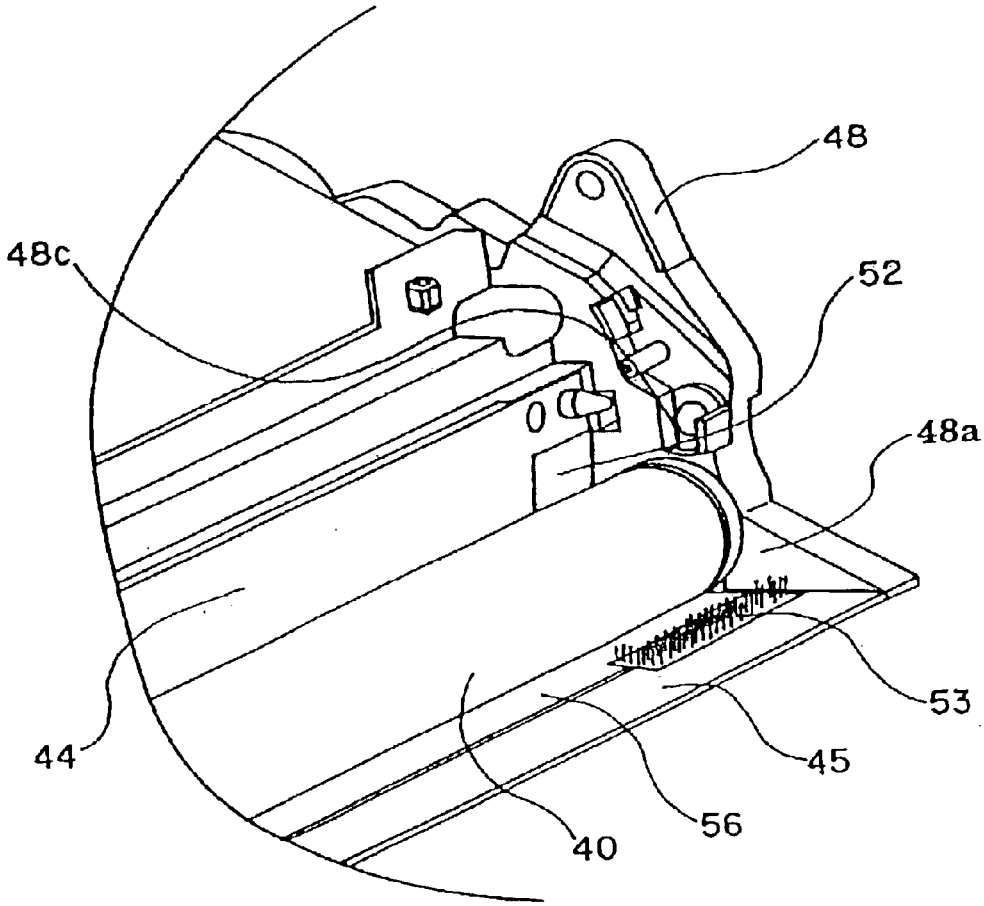
FIG. 4 is a perspective view of a first example of a developing device 4 shown in FIG. 1, illustrating one of the longitudinally ends of the developing device.

The developer collecting member 53 will be described. As shown in FIGS. 2, 3 and 4, the developer collecting member 53 is attached at the opening of the developing device container 45 so as to be kept out of contact with the developing roller 40. FIG. 4 is a partly perspective view of a first example of the developing device 4 shown in FIG. 1.

In other words, the developer collecting member 53 prevents leakage of the developer toward the outside from the opening formed between the position where the developing roller 40 supplies the developer to the photosensitive drum 1 and the position where the photosensitive drum 1 transfers an image of the developer onto the transfer material.

Although toner that was failed to be blocked by the spurt preventing sheet 56 leaks outside the apparatus through the gap between the photosensitive drum 1 and the developing device container 45 as shown in FIG. 2, such toner may be blocked by the developer collecting member 53 in the present embodiment.

As shown in FIG. 4, the developer collecting member 53 is adhered on the specified portion on the surface of the spurt preventing sheet 56 of the developing device container 45 between the position where the developing roller 40 supplies the developer to the photosensitive drum 1 and the position where the photosensitive drum 1 transfers the image of developer onto the transfer material. In the present embodiment, as shown in FIG. 4, a half of the entire area of the developer collecting member 53 is directly adhered to the developing device container 45, and the remaining half the area is overlapped on the spurt preventing sheet 56. Therefore, the developer collecting member 53 is provided between the developer returning portion at the opening of the developing device container and the edge of the developing device container.

The longitudinal dimension of the developer collecting member 53 extends outwardly to the end of the developing device container 45 and inwardly to the area about 15 mm inside with respect to the inner boundary of the end portion sealing member 52 longitudinally of the developing roller. Therefore, the end portion sealing member 52 and the developer collecting member 53 overlaps in a longitudinally direction of the developing roller. In the present embodiment, since toner blocked by the end portion sealing members 52 disposed at both ends of the developing roller and moved to the position of the spurt preventing sheet 56 (the developer returning portion) by the rotation of the developing roller 40 is larger in quantity than that in the longitudinally central area of the developing roller, the developer collecting members 53 are provided at longitudinally both ends of the developer returning portion. However, it may be provided entirely along the length thereof.

The shorter dimension thereof may be determined as desired in the area where it does not come into contact with the developing roller 40 and the photosensitive drum 1. The function of the developer collecting member 53 is to prevent leakage of toner by collecting toner by an aggregation of hairs of about 1 mm to 5 mm in length formed on the developer collecting member 53. Provision of the developer collecting member 53 also enables to store toner between the developer collecting member 53 and the developer returning portion.

The developer collecting member 53 may be formed of pile fabric, static electricity flocked sheet, felt, woven fabric and the like which does not have positively raised fibers. However, raised materials such as pile fabric or static electricity flocked sheet are specifically preferable.

The quality of material of the developer collecting member 53 may be either of chemical fibers and natural fibers for demonstrating the same effect. However, the length of the hairs is such that the satisfactory toner collecting effect cannot be obtained by the length of less than 1 mm, and that sufficient toner collecting effect cannot be achieved when the length exceeds 5 mm since the hairs are collapsed.

Toner leakage preventing walls 47*a* and 48 *a* for limiting the movement of the developer stored between the developer collecting member 53 and the developer returning portion in the direction longitudinally of the developing roller are formed on the side walls 47 and 48 on both side surfaces of the developing device container 45.

It is possible that toner failed to be collected by the aggregation of hairs of between 1 mm to 5 mm formed on the developer collecting member 53 stays in a space between the developer collecting member 53 and the developing roller 40, passage that enables leakage of toner may be blocked by forming the toner leakage preventing walls 47*a* and 48*a* integrally with the side walls 47 and 48 of the developing device container or with the cover thereof without increasing the number of components and by bringing the longitudinal outer end surface of the developer collecting member 53 into contact with the toner leakage preventing walls 47*a* and 48*a*. Consequently, toner that is failed to be collected by the developer collecting member 53 may further be prevented from leaking.

Figure 5:
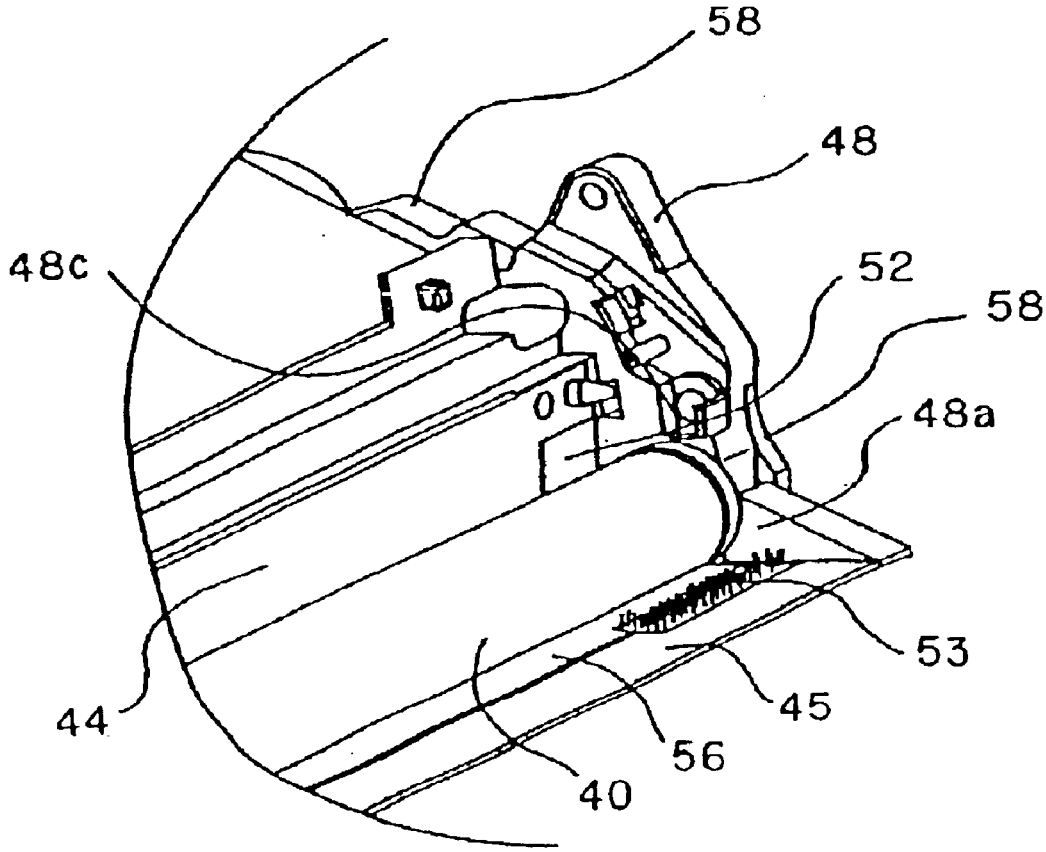
FIG. 5 is a perspective view showing partly a second example of the developing device 4 in which a bearing cover and a toner leakage protecting wall of a developing device container are integrally formed.

As shown in FIG. 5, it is also possible to form the aforementioned toner leakage preventing walls 47*a* and 48*a* integrally with a bearing cover 58 disposed outside the side walls 47 and 48, not integrally with the side walls 47 and 48 of the developing device container 45 having bearings.

The invention is not limited to the embodiment described thus far, and may be modified within the scope of the invention.

What is claimed is:

1. A developing device comprising:

a container for containing a developer;

a developing roller, which is rotatably supported by a developing device container, for developing an electrostatic latent image formed on a photosensitive drum using the developer;

a flexible sheet, one end of which is fixed to said developing device container and another end of which makes contact with said developing roller along a length thereof, for preventing spurt of developer from a gap between said developing roller and said developing device container, wherein said flexible sheet contacts said developing roller so as to allow developer that adheres on said developing roller to pass;

a developer separating roller, which is provided so as to make contact with said developing roller, for separating the developer passed through said flexible sheet from said developing roller; and a developer collecting member, at least part of which is provided on an upper surface of said flexible sheet and which is provided so as to be free of contact with said developing roller, for preventing spurt of developer from the gap between said photosensitive drum and said developing device container.

2. A developing device according to claim 1, wherein said developer collecting member is formed of a flocked sheet.

3. A developing device according to claim 1, wherein said developer collecting member is formed of a pile fabric.

4. A developing device according to any one of claims 1, 2, and 3, wherein said developer collecting member comprises a raised hairs portion which has hairs 1–5 mm in length.

5. A developing device according to any one of claims 1, 2, and 3, wherein said developer collecting member has one portion which is directly adhered to said developing container and another portion which is adhesively overlapped on said flexible sheet.

6. A developing device according to claim 1 or 2, wherein said developer collecting member is disposed longitudinally at both ends of said developing roller.

7. A developing device according to claim 6, further comprising an end portion sealing member for preventing leakage of developer from a longitudinal end of said developing roller, wherein positions of said developer collecting member and said end portion sealing member are overlapped in a longitudinal direction of said developing roller.

8. A developing device according to claim 5, wherein said developer separating roller supplies developer to said developing roller.

9. A developing device according to claim 1, wherein said developing device is detachably mountable on a main assembly of an image forming apparatus.

10. A process cartridge detachably mountable on a main assembly of an image forming apparatus, comprising:

a photosensitive drum; and a developing device including:

a container for containing a developer;

a developing roller, which is rotatably supported by a developing device container, for developing an electrostatic latent image formed on said photosensitive drum using the developer;

a flexible sheet, one end of which is fixed to said developing device container and another end of which makes contact with said developing roller along a length thereof, for preventing spurt of developer from a gap between said developing roller and said developing device container, wherein said flexible sheet contacts said developing roller so as to allow developer that adheres on said developing roller to pass;

a developer separating roller, which is provided so as to make contact with said developing roller, for separating the developer passed through said flexible sheet from said developing roller; and a developer collecting member, at least part of which is provided on an upper surface of said flexible sheet and which is provided so as to be free of contact with said developing roller, for preventing spurt of developer from the gap between said photosensitive drum and said developing device container.

11. A process cartridge according to claim 10, wherein said developer collecting member is formed of a flocked sheet.

12. A process cartridge according to claim 10, wherein said developer collecting member is formed of a pile fabric.

13. A process cartridge according to any one of claims 10, 11, and 12, wherein said developer collecting member comprises a raised hairs portion which has hairs 1–5 mm in length.

14. A process cartridge according to any one of claims 10, 11, and 12, wherein said developer collecting member has one portion which is directly adhered to said developing device container and another portion which is adhesively overlapped on said flexible sheet.

15. A process cartridge according to claim 10, or 11, wherein said developer collecting member is disposed longitudinally at both ends of said developing roller.

16. A process cartridge according to claim 15, further comprising an end portion sealing member for preventing leakage of developer from a longitudinal end of said developing roller, wherein positions of said developer collecting member and said end portion sealing member are overlapped in a longitudinal direction of said developing roller.

17. A process cartridge according to claim 14, wherein said developer separating roller supplies developer to said developing roller.

* * * * *

UNITED STATES PATENT AND TRADEMARK OFFICE

CERTIFICATE OF CORRECTION

PATENT NO. : 6,839,529 B2
DATED : January 4, 2005
INVENTOR(S) : Kojiro Yasui et al.

It is certified that error appears in the above-identified patent and that said Letters Patent is hereby corrected as shown below:

Column 9,
Line 10, “48 a” should read -- 48a --.

Column 11,
Line 1, “10, or” should read -- 10 or --.

Signed and Sealed this

Seventeenth Day of May, 2005

JON W. DUDAS
*Director of the United States Patent and Trademark Office*